US011655781B2

(12) United States Patent
Iwamoto

(10) Patent No.: US 11,655,781 B2
(45) Date of Patent: May 23, 2023

(54) CANISTER

(71) Applicant: FUTABA INDUSTRIAL CO., LTD., Okazaki (JP)

(72) Inventor: Koji Iwamoto, Okazaki (JP)

(73) Assignee: FUTABA INDUSTRIAL CO., LTD., Okazaki (JP)

( * ) Notice: Subject to any disclaimer, the term of this patent is extended or adjusted under 35 U.S.C. 154(b) by 0 days.

(21) Appl. No.: 17/716,572

(22) Filed: Apr. 8, 2022

(65) Prior Publication Data

US 2022/0333559 A1 Oct. 20, 2022

(30) Foreign Application Priority Data

Apr. 16, 2021 (JP) ..... JP2021-069775

(51) Int. Cl.
*F02M 25/08* (2006.01)

(52) U.S. Cl.
CPC .... *F02M 25/0854* (2013.01); *F02M 25/0872* (2013.01)

(58) Field of Classification Search
CPC ..... F02M 25/0854; F02M 25/0872
See application file for complete search history.

(56) References Cited

U.S. PATENT DOCUMENTS

| | | | |
|---|---|---|---|
| 5,861,050 A | 1/1999 | Pittel et al. | |
| 2009/0266236 A1 | 10/2009 | Kosugi et al. | |
| 2018/0163671 A1* | 6/2018 | Iwamoto | B01D 53/0446 |

FOREIGN PATENT DOCUMENTS

| | | |
|---|---|---|
| JP | H084605 A | 1/1996 |
| JP | 2009264273 A | 11/2009 |
| JP | 6591955 B2 | 10/2019 |

OTHER PUBLICATIONS

Non-Final Office Action for U.S. Appl. No. 17/716,561, dated Sep. 9, 2022, 7 pages.
Final Office Action for U.S. Appl. No. 17/716,561, dated Mar. 27, 2023, 8 pages.
Notice of Reasons for Refusal for Japanese Patent Application No. 2021069774, dated Mar. 14, 2023, 6 pages.
Notice of Reasons for Refusal for Japanese Patent Application No. 2021069775, dated Mar. 14, 2023, 8 pages.

* cited by examiner

*Primary Examiner* — Xiao En Mo
(74) *Attorney, Agent, or Firm* — Withrow & Terranova, P.L.L.C.; Vincent K. Gustafson

(57) ABSTRACT

A canister, mounted in a vehicle with an engine and including one or more chambers, includes adsorbents, an inflow port, an atmosphere port, an outflow port, and an adjusting member. The adjusting member is placed in a target chamber of the two or more chambers together with a corresponding adsorbent of the adsorbents. The target chamber is provided with a cushioning area located adjacent to at least one port of the ports. Two or more rod-shaped portions have first and second cross-sections orthogonal to a flow direction of an atmosphere and a fuel vapor. The first cross section is formed in the cushioning area, and the second cross-section is formed at a position distanced from the at least one port relative to the cushioning area. The first cross-section has a smaller area than an area of the second cross-section.

6 Claims, 7 Drawing Sheets

CANISTER

CROSS-REFERENCE TO RELATED APPLICATIONS

This application claims the benefit of Japanese Patent Application No. 2021-069775 filed on Apr. 16, 2021 with the Japan Patent Office, the entire disclosure of which is incorporated herein by reference.

BACKGROUND

The present disclosure relates to a canister.

There is a known canister having an adsorbent such as activated carbon placed therein. Japanese Patent No. 6591955 (JP6591955B2) discloses a canister including an adjusting member placed together with an adsorbent. The adjusting member includes elongated rod-shaped portions and a single coupling portion. The single coupling portion is arranged so as to couple respective one ends of the rod-shaped portions to one another. The rod-shaped portions smooth, in the vicinity thereof, a flow of a fuel vapor flowing into the canister and a purge air.

SUMMARY

In the canister, the higher the degree of uniformity of gas flow velocity in an extending direction (that is, a direction orthogonal to a flow direction of gas) of a chamber to be filled with the adsorbent, the adsorbent exhibits better adsorption performance. This is because since an adsorbent placed in an area of a higher gas flow velocity adsorbs a large amount of fuel vapor at an earlier stage, a capacity of such an adsorbent to adsorb the fuel vapor becomes smaller at an earlier stage. For this reason, the fuel vapor is not adsorbed in the area of the higher gas flow velocity and breakthrough the fuel vapor occurs even if an adsorbent placed in another location has an enough capacity for adsorption. The higher the rate of the adjusting member occupying a cross-section in the extending direction, the degree of uniformity of the gas flow velocity becomes lower. The canister of JP6591955B2 has two or more rod-shaped portions arranged and thus ventilation resistance is sufficiently reduced. However, it is also desired that fuel adsorption and desorption is advantageously performed by reducing breakthrough of fuel vapor.

In one aspect of the present disclosure, it is desirable to provide a technique to reduce ventilation resistance of a canister while reducing breakthrough of a fuel vapor.

One aspect of the present disclosure is a canister mounted in a vehicle with an engine and including one or more chambers. The canister comprises adsorbents, an inflow port, an atmosphere port, an outflow port, and an adjusting member. The inflow port flows a fuel vapor into the one or more chambers from a fuel tank of the vehicle. The adsorbents adsorb the fuel vapor. Each adsorbent is placed in a corresponding chamber of the one or more chambers. The atmosphere port flows an atmosphere into the one or more chambers from an outside of the vehicle. The outflow port releases the fuel vapor adsorbed by the adsorbents to the engine using the atmosphere flowing in from the atmosphere port. The adjusting member includes two or more rod-shaped portions having an elongated shape. At least one chamber of the one or more chambers is a target chamber coupled to at least one port of the inflow port, the atmosphere port, or the outflow port. The adjusting member is placed in the target chamber together with corresponding one adsorbent of the adsorbents. The target chamber is provided with a cushioning area at a side adjacent to the at least one port. The two or more rod-shaped portions have first and second cross-sections orthogonal to a flow direction of the atmosphere and the fuel vapor. The first cross-section is formed in the cushioning area and the second cross-section is formed at a position distanced from the at least one port relative to the cushioning area. The first cross-section has a smaller area than an area of the second cross-section.

In the above configuration, the adjusting member has a smaller volume in the cushioning area at the side adjacent to the at least one port. Therefore, it is possible to maintain a high degree of uniformity of a flow of the atmosphere and the fuel vapor in the cushioning area. If this degree of uniformity is low and a larger amount of the fuel vapor flows in the vicinity of the adjusting member relative to other locations, an adsorbent in the vicinity of the adjusting member reaches to a state of having no more capacity for adsorption, at relatively earlier stage, due to occurrence of breakthrough.

In the configuration above, however, it is possible to advantageously reduce an amount of fuel vapor passing through the cushioning area without being adsorbed by the adsorbent. When the cushioning area is situated at a side of a chamber communicating with a port, as compared to a configuration to situate the same at a side of the chamber not communicating with the port, it is possible to further reduce breakthrough of the fuel vapor. Accordingly, it is possible to reduce ventilation resistance of the canister while reducing breakthrough of the fuel vapor.

In one aspect of the present disclosure, the cushioning area may be an area not to arrange the adjusting member. In such a configuration, since the adjusting member is not arranged in the cushioning area, it is possible to advantageously inhibit the two or more rod-shaped portions from decreasing the degree of uniformity. Accordingly, it is possible to more advantageously reduce breakthrough of the fuel vapor.

In one aspect of the present disclosure, the adjusting member may be provided with a first abutting portion. A side wall of the target chamber may be provided with a second abutting portion. The second abutting portion abuts the first abutting portion, to thereby fix a position of the adjusting member inside the target chamber. In such a configuration, the adjusting member can be fixed in a specified position by bringing the first and second abutting portions into abutment with each other. Thus, it is possible to prevent the adjusting member from being displaced toward a port side. Accordingly, it is possible to prevent reduction in size of the cushioning area.

In one aspect of the present disclosure, a side wall of the target chamber may be provided with an abutting surface. The abutting surface abuts the adjusting member, to thereby prevent the adjusting member from being displaced toward the at least one port. In such a configuration, it is possible to prevent the adjusting member from being displaced toward the port side. Since the adjusting member is not displaced toward the portside, it is possible to prevent reduction in size of the cushioning area.

In one aspect of the present disclosure, the adjusting member may be pressed into the target chamber. In such a configuration, it is possible to prevent the adjusting member from being displaced from a position, to which the adjusting member is mounted. Accordingly, since the adjusting member is not displaced toward the port side, it is possible to prevent reduction in size of the cushioning area. Furthermore, the configuration to press the adjusting member into the target chamber makes it easy to fix the adjusting member by merely inserting of the same.

In one aspect of the present disclosure, the target chamber may be a chamber coupled to the atmosphere port. In such a configuration, the cushioning area is provided in proximity to the atmosphere port. Thus, it is possible to inhibit the fuel vapor from passing through the target chamber without being adsorbed by the adsorbent and being released from the atmosphere port to the atmosphere.

BRIEF DESCRIPTION OF THE DRAWINGS

Example embodiments of the present disclosure will be described hereinafter with reference to the accompanying drawings, in which.

DETAILED DESCRIPTION OF EXEMPLARY EMBODIMENTS

1. Embodiment

1-1. Configuration

Figure 1:
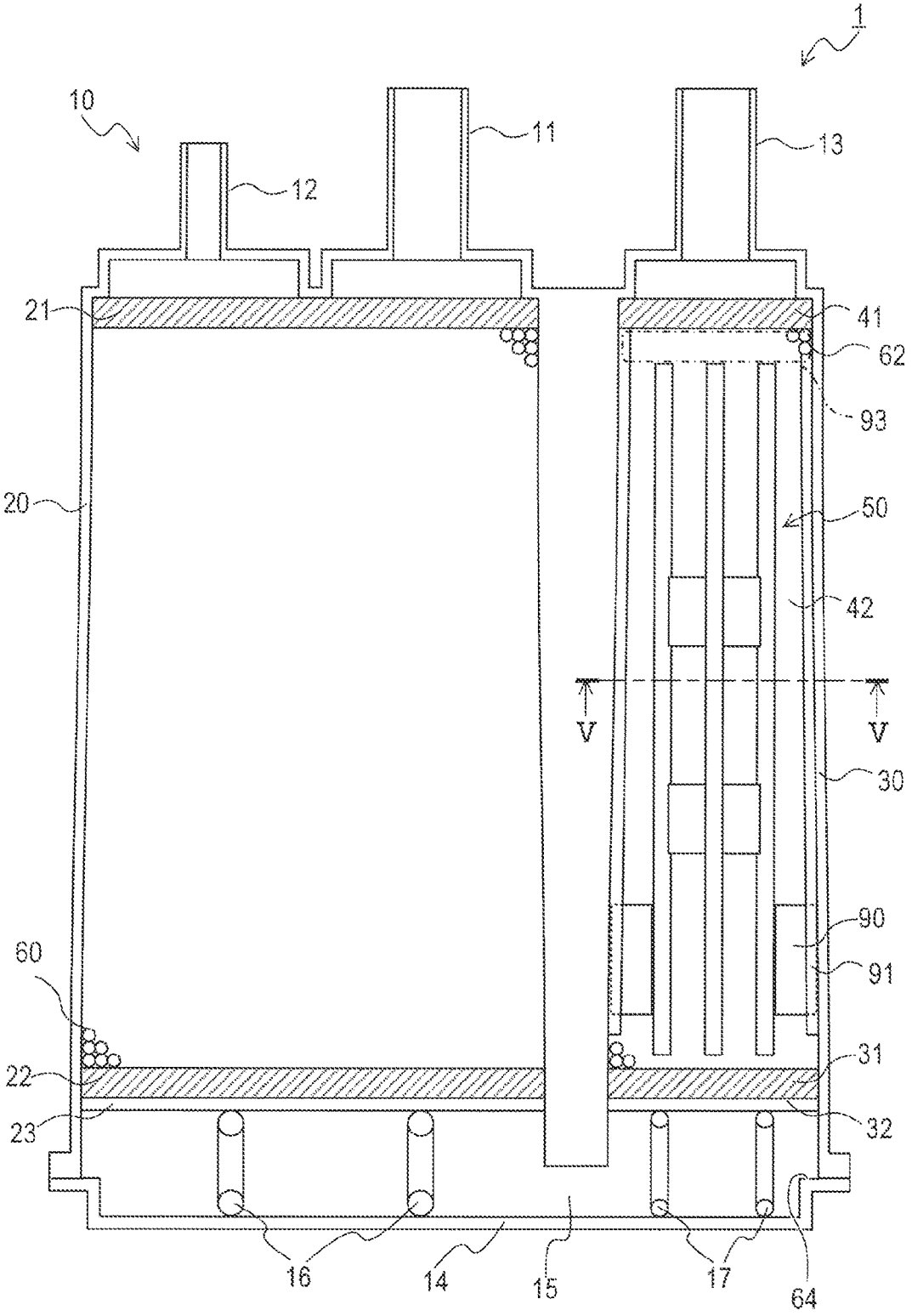
FIG. 1 is a cross-section of a canister of an embodiment as viewed laterally.

As shown in FIG. 1, there is provided a canister 1 in an embodiment. The canister 1 is mounted in a vehicle with an engine (not shown). The canister 1 includes a casing 10 made of synthetic resin. The casing 10 comprises first and second chambers 20, 30. Each of the first and second chambers 20, 30 includes an internal space. In the internal spaces of the first and second chambers 20, 30, respectively, first and second adsorbents 60, 62 to adsorb a fuel vapor are placed. The first and second adsorbents 60, 62 are an aggregate of two or more substances in powdered or granular forms. Examples of the two or more substances may include activated carbon and substances generated from activated carbon. Furthermore, examples of the two or more substances are not limited to activated carbon and may be any substances that can adsorb a fuel vapor. The first and second adsorbents 60, 62 may be of the same kind or different kinds.

The casing 10 has an end provided with an inflow port 11, an outflow port 12, and an atmosphere port 13. The internal space of the first chamber 20 communicates with the outside of the casing 10 via the inflow port 11 and the outflow port 12. Furthermore, the internal space of the second chamber 30 communicates with the outside of the casing 10 via the atmosphere port 13.

The inflow port 11 is coupled to a fuel tank (illustration omitted) of the vehicle, to thereby flow a fuel vapor into each chamber of the canister 1. The fuel tank stores a fuel to be supplied to the vehicle. The fuel vapor generated from the fuel flows into the canister 1 via the inflow port 11 and is then adsorbed by the first and second adsorbents 60, 62 placed in the first and second chambers 20, 30, respectively. Consequently, the fuel is accumulated inside the canister 1.

The outflow port 12 is coupled to an intake pipe (illustration omitted) of the engine of the vehicle. The outflow port 12 releases the fuel vapor adsorbed by the first and second adsorbents 60, 62 to the engine using an atmosphere flowing in from the atmosphere port 13. The atmosphere port 13 communicates with the outside of the vehicle. The atmosphere port 13 flows the atmosphere (hereinafter, referred to as "purge air") into each chamber the canister 1 using engine intake manifold vacuum. Due to an inflow of the purge air, the fuel vapor adsorbed by the first and second adsorbents 60, 62 (hereinafter, referred to as "desorbed fuel vapor") is desorbed. The desorbed fuel vapor is released with the purge air through the outflow port 12 toward the intake pipe. Consequently, the fuel vapor adsorbed by the activated carbon is removed, and the activated carbon is regenerated. Regenerating activated carbon in such a manner is referred to as "purge".

Detailed descriptions are given to a configuration of the canister 1. The casing 10 of the canister 1 includes first and second sides. Hereinafter, the first side, at which the inflow port 11, the outflow port 12, and the atmosphere port 13 are provided, is referred to as "port side". The casing 10 includes an opening 64 at the second side opposite to the port side. The opening 64 is closed with a lid member 14. Hereinafter, the second side (that is, the side, at which the lid member 14 is provided) opposite to the port side is referred to as "lid side".

In one example, the first chamber 20 is formed into an approximately rectangular parallelepiped shape or a cylindrical shape. The first chamber 20 is defined by a port side end communicating with the inflow port 11 and the outflow port 12. The port side end of the first chamber 20 is provided with a filter 21. The first chamber 20 is defined by a lid side end provided with a filter 22. The filters 21, 22 interpose the first adsorbent 60 therebetween. Although the first adsorbent 60 is filled in the entire space between the filters 21, 22, only a part of the adsorbent 60 filled is illustrated. The same applies to the second chamber 30.

The lid side end of the first chamber 20 communicates with a communication passage 15. The communication passage 15 extends along the lid member 14 and allows the first and second chambers 20, 30 to communicate with each other. The filter 22 and the communication passage 15 interpose a porous plate 23 having permeability to pass the fuel vapor and the purge air therethrough. Furthermore, the porous plate 23 and the lid member 14 interpose a coil spring 16. The coil spring 16 presses the porous plate 23 toward the port side. Fluid can travel between the first and second chambers 20, 30 inside the canister 1 through the communication passage 15.

The second chamber 30 has an elongated shape extending from the communication passage 15 to the atmosphere port 13. In the present embodiment, in one example, the second chamber 30 is formed into a rectangular parallelepiped shape. However, the second chamber 30 may have a different shape. In one example, the second chamber 30 may be formed into a cylindrical shape.

The second chamber 30 includes a port side end and a lid side end. The port side end of the second chamber 30 communicates with the atmosphere port 13. Furthermore, the lid side end of the second chamber 30 is provided with a filter 31. The port side end of the second chamber 30 is provided with a filter 41. The filters 31, 41 in the second chamber 30 interpose the second adsorbent 62 therebetween.

Furthermore, there is provided a porous plate 32, having permeability to pass the fuel vapor and the purge air, between the filter 31 placed at the lid side end of the second chamber 30 and the communication passage 15. The porous plate 32 and the lid member 14 interpose a coil spring 17 therebetween. The coil spring 17 presses the porous plate 32 toward the port side.

Figure 2C:
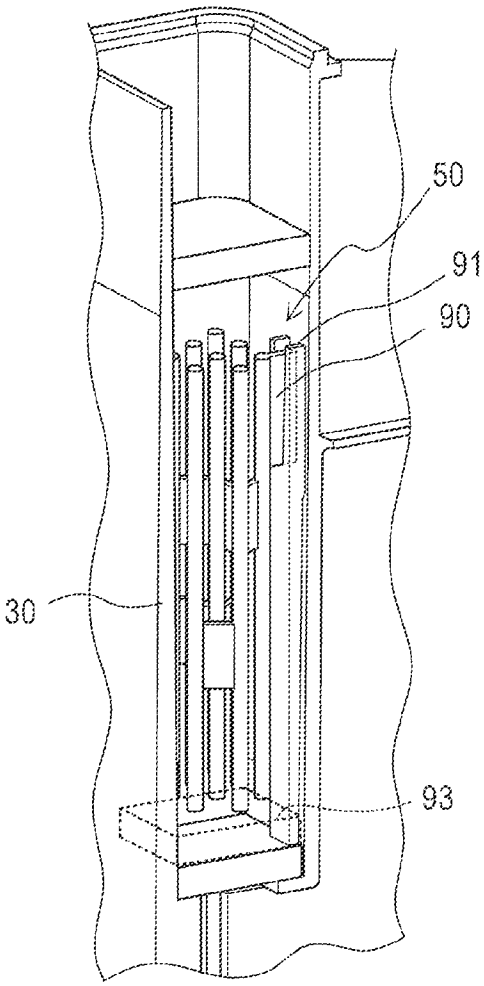
FIG. 2C is a diagram for explaining the first and second abutting portions.
Figure 2B:
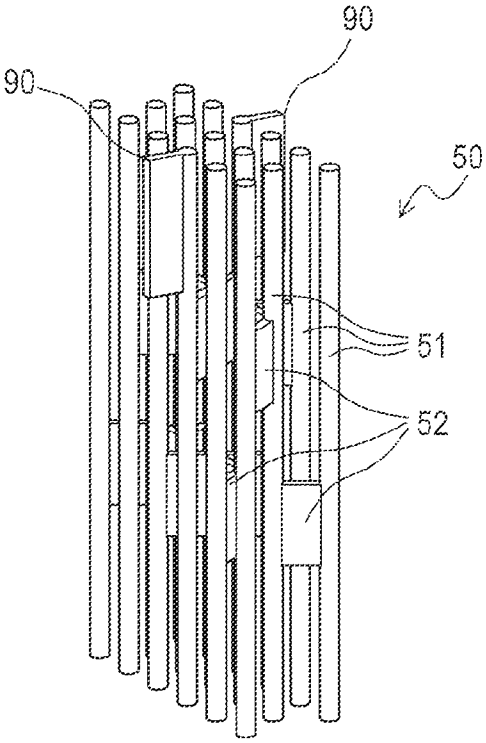
FIG. 2B is a diagram for explaining a first abutting portion.
Figure 2A:
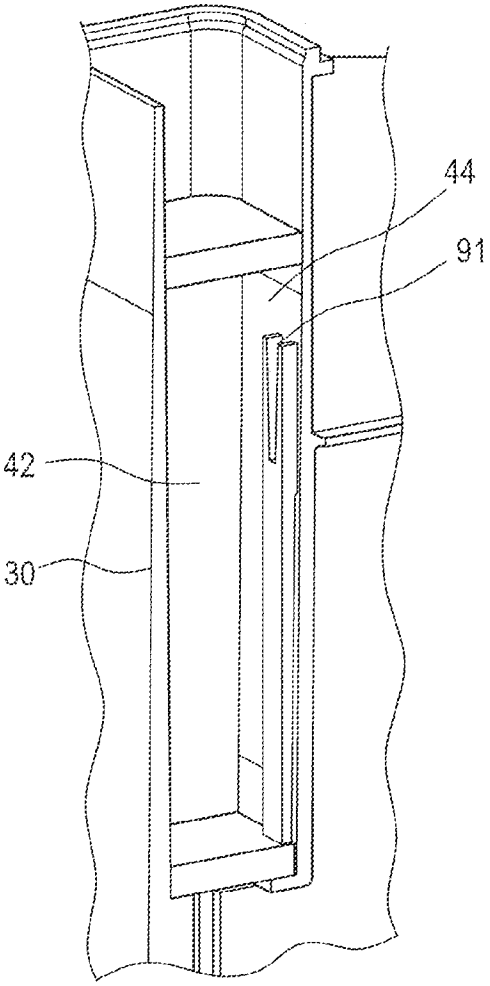
FIG. 2A is a diagram for explaining a second abutting portion.

As illustrated in FIG. 2A, there is provided a second abutting portion 91 on a side wall 44 defining the second chamber 30. The side wall 44 is a wall portion defining a lateral (or side) area of the internal space (hereinafter, referred to as "second space 42") of the second chamber 30. In FIGS. 2A, 2C, the upper side is the lid side, and the lower side is the port side. The second abutting portion 91 is provided to the side wall 44 defining the second chamber 30 at a position closer to the lid side relative to the port side. The second abutting portion 91 abuts a first abutting portion 90 to be described later, to thereby set a position of an adjusting member 50 to be described later. In the present embodiment, the second abutting portion 91 is provided with a slit.

1-2. Adjusting Member

In the present disclosure, there is at least one target chamber in one or more chambers provided to the canister 1. The target chamber is provided with the adjusting member 50 together with the second adsorbent 62. Furthermore, the target chamber is coupled to at least one port of the inflow port 11, the outflow port 12, or the atmosphere port 13. In the present embodiment, the second chamber 30 is the target chamber in one example, and the target chamber is coupled to the atmosphere port 13. Needless to say, the first chamber 20 may be the target chamber in place of the second chamber 30. Both of the first and second chambers 20, 30 may be the target chamber. Hereinafter, descriptions are given to the adjusting member 50 placed in the second chamber 30.

As illustrated in FIG. 1, the adjusting member 50 is placed with the second adsorbent 62 in the second space 42, which is an internal space of the second chamber 30.

As illustrated in FIG. 2B, the adjusting member 50 includes two or more rod-shaped portions 51 having an elongated shape, and two or more coupling portions 52.

The two or more rod-shaped portions 51 extend linearly or approximately linearly. The term "approximately linearly" means that a whole of the two or more rod-shaped portions 51 is in the form of an approximately straight line. For example, a part of or the whole of the two or more rod-shaped portions 51 may be bent at a small curvature. In other words, examples of the two or more rod-shaped portions 51 include those in which the two or more rod-shaped portions 51 appear to be a straight line. Furthermore, the two or more rod-shaped portions 51 extend in the same direction or approximately the same direction. More specifically, the two or more rod-shaped portions 51 extend in a direction from the port side to the lid side of the second chamber 30 (port-to-lid direction), or a direction approximately the same as the port-to-lid direction. In other words, the two or more rod-shaped portions 51 are arranged along a direction in which the purge air and the fuel vapor flow (hereinafter, simply referred to as "flow direction"), or a direction approximately the same as the flow direction. That is, the two or more rod-shaped portions 51 have a longitudinal axis that may be the same as the flow direction, or that may have a small angle with respect to the flow direction.

Figure 3A:
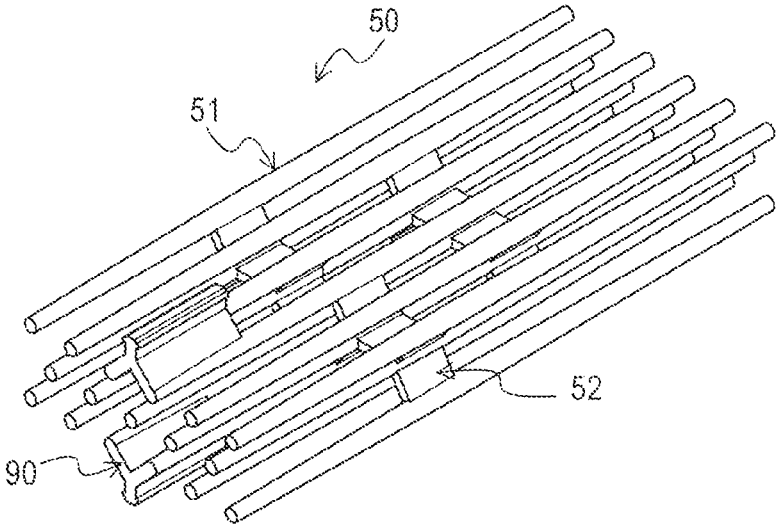
FIG. 3A is a perspective view of an adjusting member according to a modified example.
Figure 3B:
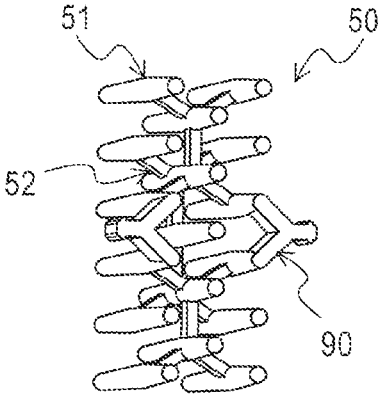
FIG. 3B is a perspective view of the adjusting member according to the modified example.
Figure 4A:
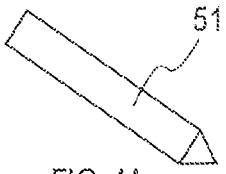
FIG. 4A is a perspective view of the adjusting member according to the modified example.
Figure 4B:
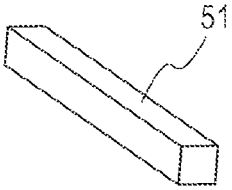
FIG. 4B is a perspective view of the adjusting member according to the modified example.
Figure 4C:
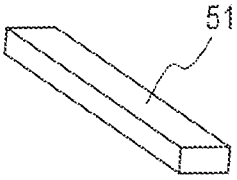
FIG. 4C is a perspective view of the adjusting member according to the modified example.
Figure 4D:
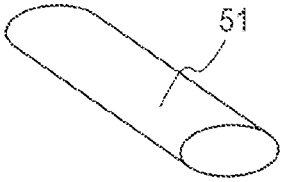
FIG. 4D is a perspective view of the adjusting member according to the modified example.
Figure 4E:
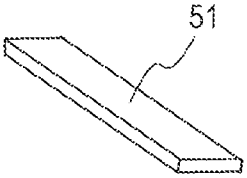
FIG. 4E is a perspective view of the adjusting member according to the modified example.
Figure 4F:
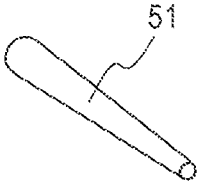
FIG. 4F is a perspective view of the adjusting member according to the modified example.

In one example, each rod-shaped portion 51 (hereinafter, simply referred to as "rod-shaped portion 51") of the two or more rod-shaped portions 51 is formed into a columnar shape as illustrated in FIGS. 1, 2B. However, the rod-shaped portion 51 may be formed into a different shape from the cylindrical shape. Specifically, as illustrated in FIGS. 3A, 3B, the rod-shaped portion 51 may be formed to have a diameter gradually decreasing toward a leading end thereof. Furthermore, example shapes of the rod-shaped portion 51 may include a polygonal columnar shape and more specifically, a triangular prism shape as illustrated in FIG. 4A and a quadrangular prism shape having a square or a rectangular shape in a cross-section as illustrated in FIGS. 4B, 4C. Furthermore, example cross-sectional shapes of the rod-shaped portion 51 may include an oval shape as illustrated in FIG. 4D. Still further, example shapes of the rod-shaped portion 51 may include a band-like shape as illustrated in FIG. 4E and a tapered shape as illustrated in FIG. 4F.

On the other hand, the two or more coupling portions 52 are provided to the two or more rod-shaped portions 51 in a state of being separated from one another. The two or more coupling portions 52 couple the two or more rod-shaped portions 51 to one another, to form as one integral member. In the present embodiment, the two or more coupling portions 52 are arranged to be distributed to two distinctive positions in the flow direction. The adjusting member 50 may include the two or more rod-shaped portions 51 having an elongated shape, and a single coupling portion 52.

Furthermore, the two or more rod-shaped portions 51 have surrounding spaces (in other words, lateral spaces) communicating with one another. Specifically, adjacent rod-shaped portions 51 of the two or more rod-shaped portions 51 are placed with a given distance or more provided from each other. Since there is no area enclosed by the two or more rod-shaped portions 51 in the second space 42, there is no area isolated from other areas in the second space 42.

Figure 5:
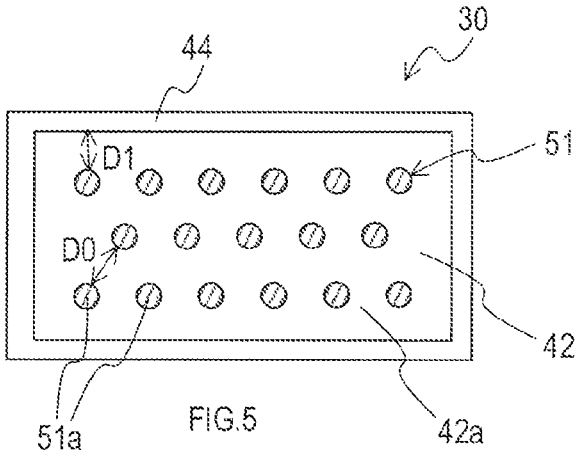
FIG. 5 is a cross-section, along a line V-V in FIG. 1, schematically illustrating an internal space of a second chamber of the canister according to the embodiment.

As illustrated in FIG. 5, the two or more rod-shaped portions 51 are arranged in a manner to be spread uniformly or approximately uniformly along a cross-section orthogonal to a longitudinal axis of the second chamber 30. Furthermore, the two or more rod-shaped portions 51 are placed with a given distance or more provided from the side wall 44 defining the lateral area of the second space 42. Still further, the two or more rod-shaped portions 51 are placed in a manner to pass through a center of the second space 42 in a width axis and its surrounding area.

As illustrated in FIG. 2B, the adjusting member 50 is provided with the first abutting portion 90. In the present embodiment, the first abutting portion 90 is a plate-shaped portion protruding from a specific rod-shaped portion of the two or more rod-shaped portions 51. The first abutting portion 90 is provided to the adjusting member 50 at two specific locations. As illustrated in FIG. 2C, the first abutting portion 90 is pressed into the slit of the second abutting portion 91, whereby the position of the first abutting portion 90 is set. The term "press(ed) into" here means to insert an object into a space having a smaller width relative to a width of the object. Alternatively, the term "press(ed) into" means to insert an object into a space having the same width as the object. Such insertion generates a friction between an inserting body to be inserted into a space and a receiving body defining the space. As a result, the inserting body is prevented from falling off the receiving body. In the present embodiment, the adjusting member 50, which is slightly larger than a width of the second space 42, is pressed into the second chamber 30. Also, the first abutting portion 90, which has a width larger than a width of the slit, is fitted and pressed into the slit. Consequently, it is possible to prevent the first abutting portion 90 from falling off the slit of the second abutting portion 91. Furthermore, due to the first abutting portion 90 being fitted into the slit, the position of the adjusting member 50 is set. FIG. 2B illustrates a configuration to provide one first abutting portion 90 to one rod-shaped portion. However, example configurations may include one illustrated in FIGS. 3A, 3B in which two plates protruding from two rod-shaped portions 51 merge into one to have an approximately Y-shape in a cross-section orthogonal to a longitudinal axis of the adjusting member 50.

As illustrated in FIG. 1, the second chamber 30 includes a cushioning area 93 in an area of the second space 42 at the port side. In the present embodiment, the cushioning area 93 is an area not to arrange the two or more rod-shaped portions 51. In one example, the adjusting member 50 is arranged with a space left across the entire area thereabove, below the filter 41 for less than 10 mm. In the flow direction, the cushioning area 93 is narrower than the area to place the adjusting member 50. The area not to arrange the two or more rod-shaped portions 51 may be about 2 mm in the flow direction, for example. Alternatively, such an area may be of approximately the same size as an average particle diameter of a granule or a powder of the second adsorbent 62 in the flow direction. Furthermore, in the flow direction, the cushioning area 93 may be provided to the target chamber at the port side so as to have a length of 30% or less of the length of the target chamber.

Figure 4G:
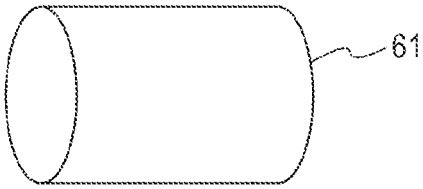
FIG. 4G is a perspective view of a pellet.

The second adsorbent 62 to be placed in the second chamber 30 may be an aggregate of two or more granular substances having a specified shape. Specifically, examples of the second adsorbent 62 may include an aggregate of two or more pellets 61. The two or more pellets 61 are granular activated carbon. The two or more pellets 61 are produced by kneading powdered activated carbon with a binder, and forming the powdered activated carbon kneaded into a specified shape. As illustrated in FIG. 4G, each pellet 61 of the two or more pellets 61 (hereinafter, simply referred to as "pellet 61") in the present embodiment is formed into a cylindrical shape in one example. In one example, the diameter of two base surfaces of the pellet 61 may be about 2 mm. Furthermore, in one example, the distance (in other words, the length) between the two base surfaces of the pellet 61 may be in a range of about 3 mm through 5 mm. The pellet 61 may have a different shape. Furthermore, an adsorbent different from the pellet 61 may be placed in the second chamber 30, such as powdered activated carbon.

The given distance (in one example, D0 in FIG. 5) between the adjacent rod-shaped portions 51 is determined based on a size of the pellet 61. Specifically, the given distance may be longer than, for example, the diameter of the two base surfaces of the pellet 61 or the length of the pellet 61.

Furthermore, the smallest value of the distance (in one example, D1 in FIG. 5) between a side part of the rod-shaped portion 51 and the side wall 44 defining the second space 42 is also determined based on the size of the pellet 61. Specifically, the smallest value may be larger than, for example, a value of the diameter of the two base surfaces of the pellet 61 or a value of the length of the pellet 61. In other words, a distance(s) between a side part(s) of one or more outermost rod-shaped portions 51 of the two or more rod-shaped portions 51 and the side wall 44 defining the second space 42 may be longer than, for example, the diameter of the two base surfaces of the pellet 61 or the length of the pellet 61.

The second space 42 has a cross-section orthogonal to the flow direction (in other words, directions in which lid side and port side surfaces defining the second space 42 face each other). Such a cross-section is referred to as "orthogonal cross-section". The reference numeral 42*a* in FIG. 5 shows the orthogonal cross-section of the second space 42. Furthermore, a total cross-sectional area of the two or more rod-shaped portions 51 in the orthogonal cross-section is referred to as "total cross-sectional area". The reference numeral 51*a* in FIG. 5 shows cross-sections of the two or more rod-shaped portions 51 in the orthogonal cross-section 42*a*. The number of the two or more rod-shaped portions 51 and the thickness of each rod-shaped portion 51 may be configured such that the total cross-sectional area is 1% or more and 30% or less of a total area of the orthogonal cross-section 42*a*. As a result, it is possible to reduce ventilation resistance while advantageously performing fuel adsorption and desorption in the second chamber 30.

In one example, in the orthogonal cross-section 42*a* illustrated in FIG. 5, the total cross-sectional area is about 7.5% of the total area of the orthogonal cross-section 42*a*.

Furthermore, in the present embodiment, the second space 42 is an elongated space having a fixed width. Each rod-shaped portion 51 is formed into a columnar shape having a fixed width. That is, the size of the orthogonal cross-section 42*a* and the size of the cross-section of each rod-shaped portion 51 are fixed and not affected by what position, in the second space 42, the orthogonal cross-section 42*a* is formed.

However, the width of the second space 42 and/or the width of each rod-shaped portion 51 may not be fixed. That is, the size of the orthogonal cross-section 42*a* and/or the size of the cross-section of each rod-shaped portion 51 may vary depending on what position, in the second space 42, the orthogonal cross-section 42*a* is formed. In this case, the number of the two or more rod-shaped portions 51 and the thickness of each rod-shaped portion 51 may be configured such that the total cross-sectional area is 1% or more and 30% or less of the total area of the orthogonal cross-section 42*a* regardless of what location, in the second space 42, the orthogonal cross-section 42*a* is formed. In the cushioning area 93 in the present embodiment, the total cross-sectional area is configured to be 0% of the total area of the orthogonal cross-section 42*a*. The two or more pellets 61 are spread over the cushioning area 93. The total cross-sectional area in the cushioning area 93 may have any value smaller than the total cross-sectional area in an area other than the cushioning area 93.

1-3. Effects

The embodiment detailed above can bring effects to be described below.

(1a) The canister 1 comprises the cushioning area 93, where the two or more rod-shaped portions 51 are not arranged. In such a configuration, it is possible to advantageously inhibit the two or more rod-shaped portions 51 from decreasing the degree of uniformity of the gas flow velocity. Accordingly, it is possible to more advantageously reduce breakthrough of the fuel vapor.

(1b) The adjusting member 50 comprises the first abutting portion 90. The side wall 44 defining the second chamber 30 is provided with the second abutting portion 91. In such a configuration, the adjusting member 50 can be fixed in a specified position by bringing the first and second abutting portions 90, 91 into abutment with each other. Accordingly, since the adjusting member 50 is not displaced toward the port side, it is possible to prevent reduction in size of the cushioning area 93.

(1c) The adjusting member 50 is pressed into the second chamber 30. In such a configuration, it is possible to prevent the adjusting member 50 from being displaced from a position, to which adjusting member 50 is mounted. Accordingly, since the adjusting member 50 is not displaced toward the port side, it is possible to prevent reduction in size of the cushioning area 93. Furthermore, the configuration to press the adjusting member 50 into the second chamber 30 makes it easy to fix the adjusting member 50 by merely inserting of the same.

(1d) The distance between the adjacent rod-shaped portions 51 is determined based on the size of the pellet 61. Thus, an adequate distance is provided between the adjacent rod-shaped portions 51. Consequently, the two or more pellets 61 are spread over an entire space(s) between the two or more rod-shaped portions. This inhibits generation of an excessively large gap(s) between the two or more pellets 61 to be filled in the space(s). Accordingly, the space(s) is/are adequately filled with the two or more pellets 61.

(1e) The smallest value of the distance between the side part of the rod-shaped portion 51 and the side wall 44 defining the second space 42 is determined based on the size of the pellet 61. Thus, an adequate distance is provided between the rod-shaped portion 51 and the side wall 44. Consequently, the two or more pellets 61 are spread over entire spaces between the two or more rod-shaped portions 51 and the side wall 44. This inhibits generation of an excessively large gap(s) between the two or more pellets 61 to be filled in the spaces. Accordingly, the spaces are adequately filled with the two or more pellets 61.

(1f) The number of the two or more rod-shaped portions 51 and the thickness of each rod-shaped portion 51 are configured such that the total cross-sectional area is 1% or more and 30% or less of the total area of the orthogonal cross-section 42*a* of the second space 42. Thus, in the second chamber 30, it is possible to reduce ventilation resistance while advantageously performing fuel adsorption and desorption. The effect described in (1a) above is significantly enhanced when the total cross-sectional area in the cushioning area 93 is one third or less of the total cross-sectional area in the area other than the cushioning area 93. As in the present embodiment, in the case where the total cross-sectional area in the area other than the cushioning area 93 is about 7.5% of the total area of the orthogonal cross-section 42*a*, the effect is significantly enhanced when the total cross-sectional area in the cushioning area 93 is 2.5% or less of the total area of the orthogonal cross-section 42*a*.

(1g) The cushioning area 93 is provided to the second chamber 30 coupled to the atmosphere port 13. In such a configuration, since the cushioning area 93 is provided in proximity to the atmosphere port 13, it is possible to inhibit the fuel vapor from passing through the target chamber without being adsorbed by the second adsorbent 62 and being released from the atmosphere port 13 to the atmosphere.

2. Other Embodiments

Although the embodiments of the present disclosure have been described hereinabove, the present disclosure is not limited to the above-described embodiments and may be practiced in various forms.

Figure 6:
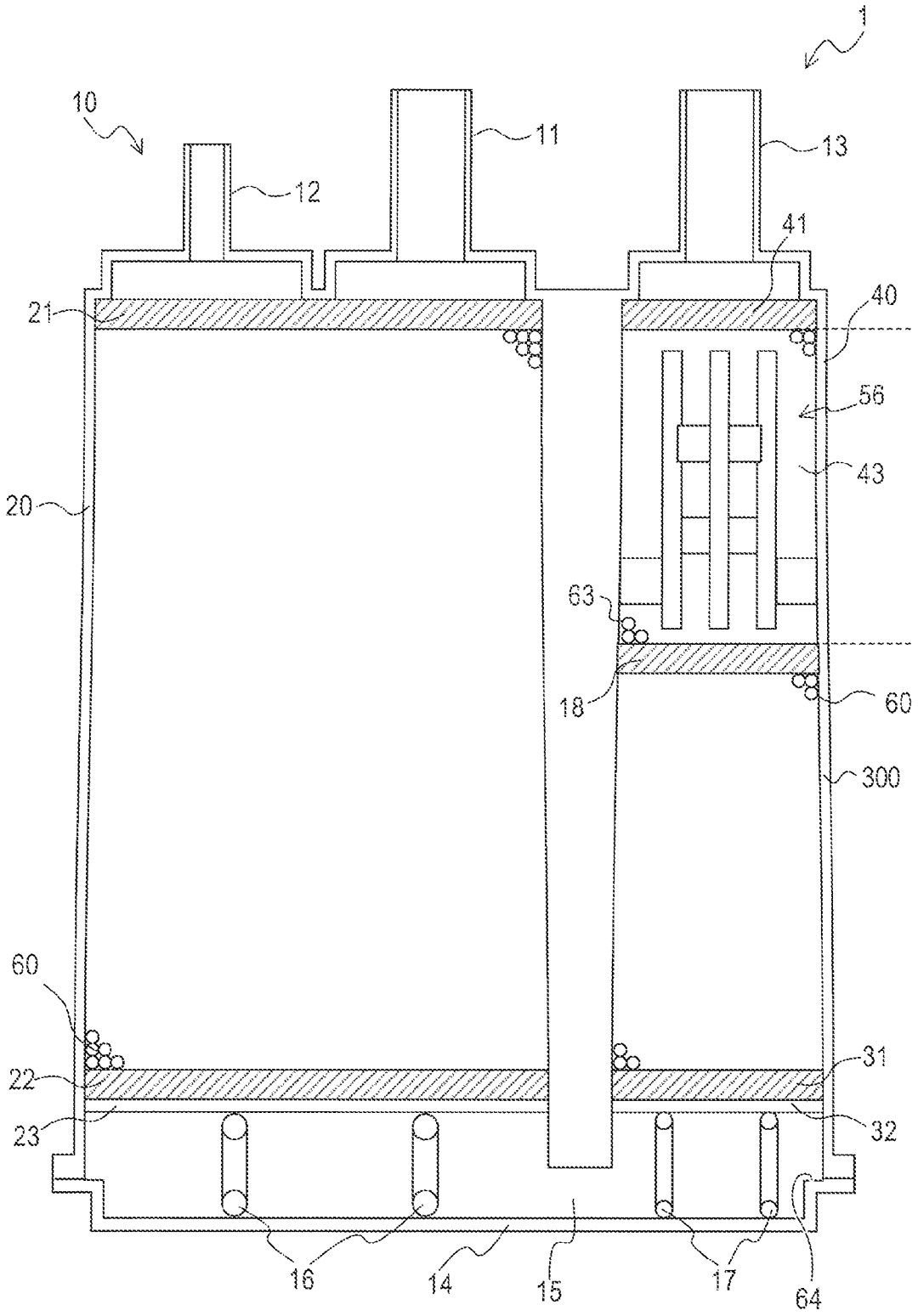
FIG. 6 is a cross-section of a canister according to the modified example as viewed laterally.

(2a) In the above embodiment, the canister 1 includes two chambers. However, the canister 1 may include one chamber, or three or more chambers. Even in these cases, at least one chamber may be configured as the target chamber, in which the adjusting member 50 is placed. For example, FIG. 6 illustrates a case where the canister 1 includes three chambers. Second and third chambers 300, 40 are arranged adjacent to the first chamber 20. Each of the second and third chambers 300, 40 has an elongated shape extending from the lid side to the port side. The second and third chambers 300, 40 are aligned in this order in a lid-to-port direction with a port side end of the second chamber 300 and a lid side end of the third chamber 40 being adjacent to each other. The second and third chambers 300, 40 are partitioned by a partitioning member 18. The partitioning member 18 has permeability. The partitioning member 18 may include, for example, a porous plate and/or a filter. Fluid can pass through the partitioning member 18 and travel between the second and third chambers 300, 40 inside the canister 1. The third chamber 40 has a port side end communicating with the atmosphere port 13. In this modified example, the third chamber 40 is the target chamber. In the third chamber 40, an adjusting member 56 is placed together with an adsorbent 63. The adjusting member 56 has the same configuration as the adjusting member 50 of the above embodiment. The adsorbent 63 may be of the same kind as or a different kind from the first and second adsorbents 60, 62.

(2b) In the above embodiment, the two or more rod-shaped portions 51 are placed in the at least one target chamber while extending along the flow direction. Furthermore, the two or more rod-shaped portions 51 extend linearly or approximately linearly. However, the two or more rod-shaped portions 51 may extend in the flow direction in a state of, for example, being curved or bent at one or more locations. Furthermore, the two or more rod-shaped portions 51 may extend helically in the flow direction, for example. Still further, the two or more rod-shaped portions 51 may have different shapes.

Still further, the two or more rod-shaped portions 51 may extend along a direction different from the flow direction. The two or more rod-shaped portions 51 may extend in different directions from one another. If there are three or more rod-shaped portions 51, two rod-shaped portions 51 may extend in one direction, and the rest of the rod-shaped portion(s) 51 may extend in another direction.

(2c) The above embodiment exemplifies a configuration to provide the cushioning area 93 adjacent to the atmosphere port 13. However, the position to provide the cushioning area 93 is not limited thereto. For example, the cushioning area 93 may be provided to a chamber, to which the inflow port 11 or the outflow port 12 is provided. Specifically, the first chamber 20 in FIG. 1 may comprise an adjusting member. The adjusting member may be arranged at a positon distanced from the inflow port 11 or the outflow port 12. For example, the adjusting member 50 may be arranged with a space left across the entire area thereabove, below the filter 21 for less than 10 mm.

(2d) The above embodiment exemplifies a configuration not to arrange the adjusting member 50 in the cushioning area 93. However, the configuration of the cushioning area 93 is not limited hereto. The cushioning area 93 may have any configuration in which the two or more rod-shaped portions 51 arranged therein have first and second cross-sections orthogonal to the flow direction. The first cross-section is formed in the cushioning area 93 and the second cross-section is formed at a position distanced from the atmosphere port 13 relative to the cushioning area 93. The first cross-section has a smaller area than an area of the second cross-section. For example, the cushioning area 93 may have a configuration in which the number of the two or more rod-shaped portions 51 arranged therein is smaller relative to the number of the two or more rod-shaped portions 51 arranged at a position distanced from the atmosphere port 13. Furthermore, the cushioning area 93 may have a configuration in which the thickness of each rod-shaped portion 51 located therein is smaller relative to the thickness of the same located apart from the atmosphere port 13.

In such a configuration, the two or more rod-shaped portions 51 have a smaller volume in the cushioning area 93 located in the chamber communicating with the atmosphere port 13. Therefore, in the cushioning area 93, it is possible to maintain a high degree of uniformity of the flow of the purge air and the fuel vapor. If this degree of uniformity is low and a larger amount of the fuel vapor flows in the vicinity of the adjusting member 50 relative to other locations, the second adsorbent 62 in the vicinity of the adjusting member 50 reaches a state of having no more capacity for adsorption at relatively earlier stage due to occurrence of breakthrough. In the configuration above, however, it is possible to advantageously reduce an amount of fuel vapor passing through the cushioning area 93 without being adsorbed by the second adsorbent 62. When the cushioning area 93 is situated at a side of a chamber communicating with a port, as compared to a configuration to situate the same at a side of the chamber not communicating with the port, it is possible to further reduce breakthrough of the fuel vapor. Accordingly, it is possible to reduce ventilation resistance of the canister 1 while reducing breakthrough of the fuel vapor.

(2e) The above embodiment exemplifies a configuration to provide the first abutting portion 90 to the adjusting member 50 at the two specific locations. However, the number of the first and second abutting portions 90, 91 are not limited hereto. For example, each of the first and second abutting portions 90, 91 may be provided at one specific location, or three or more specific locations.

Figure 7B:
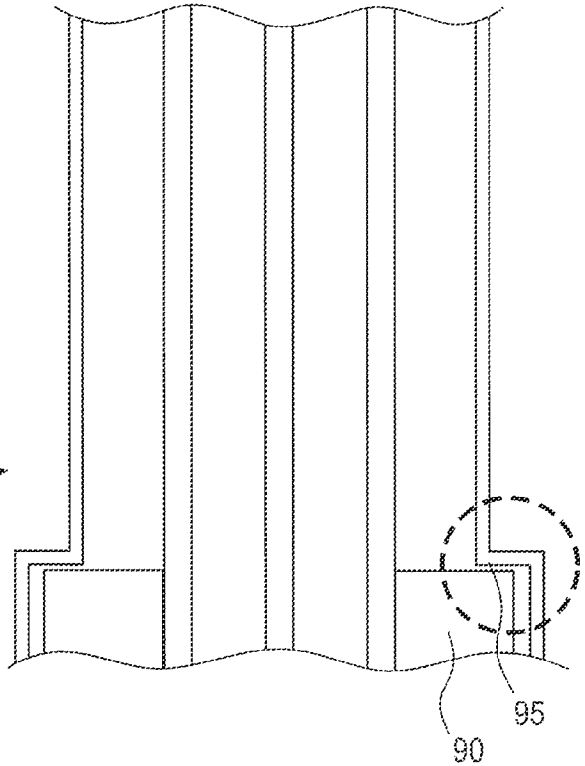
FIG. 7B enlarges the schematic view of the second abutting portion according to the modified example.
Figure 7A:
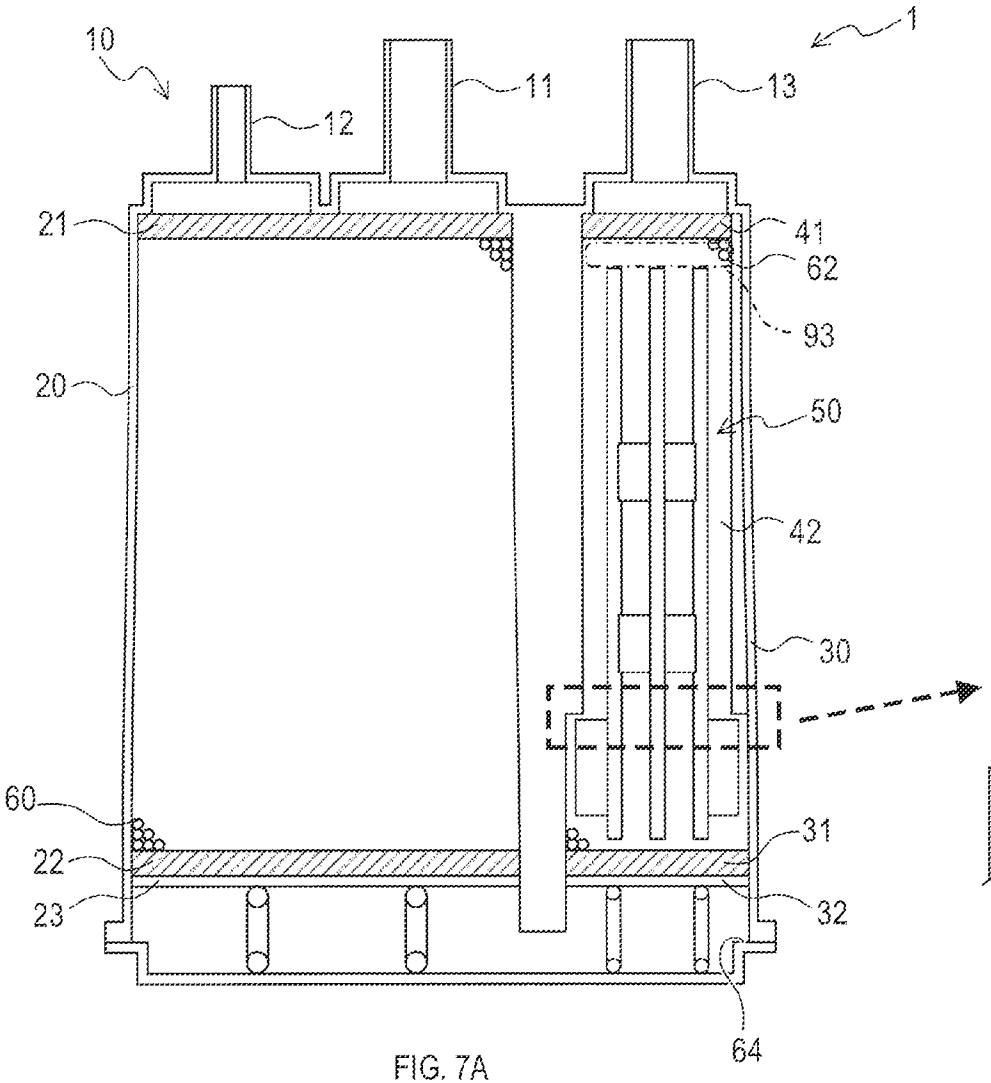
FIG. 7A is a schematic diagram of a second abutting portion according to the modified example.

(2f) The above embodiment exemplifies a configuration to fit the first abutting portion 90 into the second abutting portion 91 provided with a slit. Also, the above embodiment exemplifies a configuration to press the adjusting member 50 into the target chamber. However, a configuration to fix the adjusting member 50 into the target chamber is not to be limited hereto. For example, the adjusting member 50 may have a snap-fit configuration in which a claw is engaged with a hole for fixation. Furthermore, as illustrated in FIGS. 7A, 7B, an abutting surface 95 may be formed. The abutting surface 95 abuts the adjusting member 50 to prevent the same from being displaced toward the atmosphere port 13. In such a configuration, since the first abutting portion 90 is obstructed by the abutting surface 95, it is possible to prevent the adjusting member 50 from being displaced toward the atmosphere port 13. Since the adjusting member 50 is not displaced toward the port side, it is possible to prevent reduction in size of the cushioning area 93. Accordingly, it is possible to maintain the degree of uniformity of the purge air and the fuel vapor in the cushioning area 93.

(2g) One or more functions of one element of the aforementioned embodiments may be distributed to two or more elements, and one or more functions of two or more elements may be integrated into one element. Furthermore, a part of the configurations of the aforementioned embodiments may be omitted. Still further, at least a part of the configurations of the aforementioned embodiments may be added to or replaced with configurations of the other above-described embodiments.

What is claimed is:

1. A canister mounted in a vehicle with an engine and including one or more chambers, the canister comprising:

an inflow port flowing a fuel vapor into the one or more chambers from a fuel tank of the vehicle;

adsorbents adsorbing the fuel vapor, each adsorbent being placed in a corresponding chamber of the one or more chambers;

an atmosphere port flowing an atmosphere into the one or more chambers from an outside of the vehicle;

an outflow port releasing the fuel vapor adsorbed by the adsorbents to the engine using the atmosphere flowing in from the atmosphere port; and an adjusting member including two or more rod-shaped portions having an elongated shape, wherein at least one chamber of the one or more chambers is a target chamber coupled to at least one port of the inflow port, the atmosphere port, or the outflow port, wherein the adjusting member is placed in the target chamber together with corresponding one adsorbent of the adsorbents, wherein the target chamber is provided with a cushioning area at a side adjacent to the at least one port, and wherein the two or more rod-shaped portions have a first cross-section and a second cross-section orthogonal to a flow direction of the atmosphere and the fuel vapor, the first cross-section being formed in the cushioning area, the second cross-section formed at a position distanced from the at least one port relative to the cushioning area, the first cross-section has a smaller area than an area of the second cross-section.

2. The canister according to claim 1, wherein the cushioning area is an area not to arrange the adjusting member.

3. The canister according to claim 1, wherein the adjusting member is provided with a first abutting portion, and wherein a side wall of the target chamber is provided with a second abutting portion, the second abutting portion abutting the first abutting portion, to thereby fix a position of the adjusting member inside the target chamber.

4. The canister according to claim 1, wherein a side wall of the target chamber is provided with an abutting surface, the abutting surface abutting the adjusting member, to thereby prevent the adjusting member from being displaced toward the at least one port.

5. The canister according to claim 1, wherein the adjusting member is pressed into the target chamber.

6. The canister according to claim 1, wherein the target chamber is a chamber coupled to the atmosphere port.

* * * * *